United States Patent [19]

Harmon et al.

[11] 4,282,898

[45] Aug. 11, 1981

[54] FLOW METERING VALVE WITH OPERATOR SELECTABLE BOOSTED FLOW

[75] Inventors: James L. Harmon, Joliet; John A. Junck, Sandwich, both of Ill.

[73] Assignee: Caterpillar Tractor Co., Peoria, Ill.

[21] Appl. No.: 144,148

[22] PCT Filed: Nov. 29, 1979

[86] PCT No.: PCT/US79/01033

§ 371 Date: Nov. 29, 1979

§ 102(e) Date: Nov. 29, 1979

[87] PCT Pub. No.: WO81/01595

PCT Pub. Date: Jun. 11, 1981

[51] Int. Cl.[3] ..... F15B 13/042

[52] U.S. Cl. ..... 137/596.13; 91/446; 91/451; 137/596.15

[58] Field of Search ..... 91/446, 451; 137/596.13, 596.15

[56] References Cited

U.S. PATENT DOCUMENTS

| | | | |
|---|---|---|---|
| 3,402,736 | 9/1968 | Trick . | |
| 3,455,210 | 7/1969 | Allen . | |
| 3,587,630 | 6/1971 | Dike et al. . | |
| 3,768,372 | 10/1973 | McMillen . | |
| 3,831,620 | 8/1974 | Bianchetta et al. . | |
| 3,878,679 | 4/1975 | Stevenpiper . | |
| 3,901,264 | 8/1975 | Stephens . | |
| 3,911,942 | 10/1975 | Becker . | |
| 4,070,857 | 1/1978 | Wible . | |
| 4,121,610 | 10/1978 | Harms et al. | 137/596.12 X |
| 4,209,039 | 6/1980 | Budzich | 137/596.13 |

FOREIGN PATENT DOCUMENTS 1494400 12/1977 United Kingdom .

*Primary Examiner*—Gerald A. Michalsky
*Attorney, Agent, or Firm*—Phillips, Moore, Weissenberger, Lempio & Majestic

[57] ABSTRACT

Heretofore the capability of operating a system (10), which supplies fluid to a hydraulic circuit (12), selectively at either a high or a low flow rate with only a single pressurized fluid source (14) has not existed. Such a system (10) includes a control valve structure (16) for controlling delivery of fluid from the source (14) to drive the circuit (12) and a flow control (22) for metering a portion of the fluid to the circuit (12). The capability of operating such a system (10) selectively at either a high or a low flow rate is advantageous in some modes of operation of the circuit (12). Herein, hydraulic circuitry (86) serves for controlling the magnitude of the portion in response to application of a signal thereto and a device (78) is provided for selectively applying the signal to the circuitry (86) for selectively directly controlling the magnitude of the portion.

6 Claims, 1 Drawing Figure

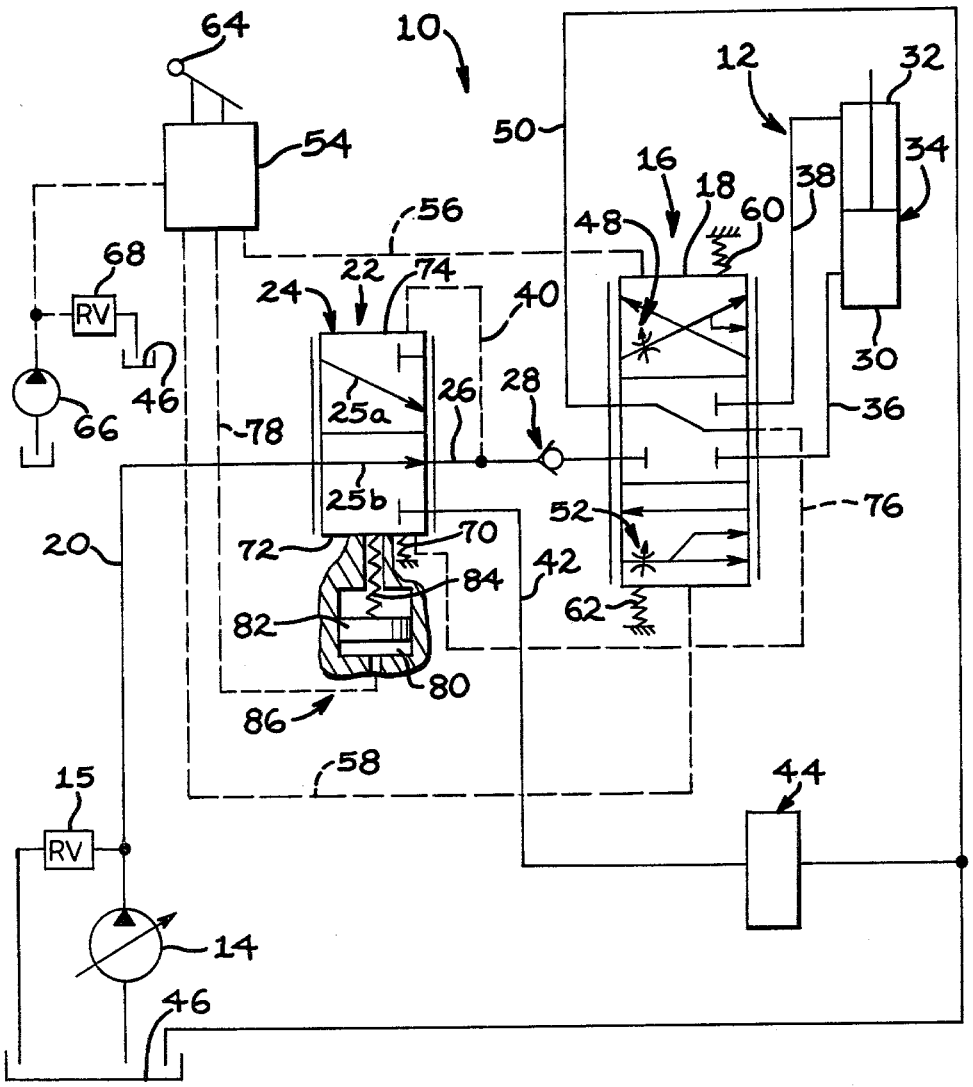
64
10
12
32
54
50
34
16
18
38
60
56
48
68
22
74
24
40
RV
30
46
26
28
66
25a
36
78
25b
76
52
20
72
70
42
84
62
82
80
86
58
15
44
RV
14
46

FLOW METERING VALVE WITH OPERATOR SELECTABLE BOOSTED FLOW

DESCRIPTION

1. Technical Field

This invention relates to a system for supplying fluid flow from a pump to a hydraulic work circuit, and, in particular, relates to supplying different amounts of flow of pressurized fluid to the circuit directly responsive to an operator produced signal.

2. Background Art

In a number of vehicles, for example, in track type tractors, different flow rates of hydraulic fluid are desirable for accomplishing different operational functions. For example, a larger flow rate may be desirable for raising the blade of a track type tractor, whereas a lower flow rate may be desirable for lowering that same blade. Further, it may be desirable to be able to carry out the same function at different rates. That is, in some modes of operation it may be desirable to be able to slowly and controllably raise the blade of a track type tractor, while in other modes of operation it may be desirable to have a very high flow rate so that the blade can be raised very quickly.

The prior art has generally accomplished such different modes of operation as are discussed above by utilizing two separate pumps. When a higher flow rate is desired, both pumps are used. When a lower flow rate is desired, one of the pumps simply has its flow returned to sump. This is, however, an expensive and space consuming way of attaining the desired result. Further, it introduces the presence of extra controls, extra hydraulic lines, etc. Thereby, extra chances of breakdown of components are introduced by operating via the two pump method.

The prior art also shows flow rate control from a single pressure source responsive to functioning of an additional working circuit, as opposed to being responsive to an operator signal. U.S. Pat. No. 3,768,372 issued Oct. 30, 1973 to K. G. McMillen discloses such a system. In this patent, the flow through a flow metering valve to a working circuit is varied. However, the variation is responsive to the working pressure of a higher priority working circuit rather than being responsive to an operator created signal. Thus, the operator cannot choose high or low flow rate at his option.

A system which would operate utilizing a single pump of either a high flow variety or variable flow variety, but would still have the capability of being operated selectively at a high or low flow rate, would thus have very significant advantages over piror art structures which have been utilized to provide the aforementioned desirable functional characteristics.

DISCLOSURE OF INVENTION

The present invention is directed to overcoming one or more of the problems as set forth above.

According to the present invention, an improvement is provided in a system for supplying fluid flow to a hydraulic work circuit, the system having a pressurized fluid source, control means for controlling delivery of fluid flow from the source to selectively drive the circuit, and flow metering means for metering a portion of the fluid flow to the hydraulic work circuit. The improvement in accordance with the present invention comprises means for controlling the magnitude of the portion metered to the hydraulic circuit responsive to an operator produced signal.

When operating in accordance with the present invention one can attain either low or high flow for different functions of a hydraulic circuit, for example for lowering and raising the blade of a track type tractor. Further, one can attain different flows within a single function, i.e., one can attain either a slow raising of the blade of the tractor or a faster raising of the same blade, and all of the above is initiated via an operator produced signal. As a result, it is not necessary to utilize two separate pumps with the added expense, space wastage, extra controls and extra breakdown possibilities introduced by the use of an additional pump.

BRIEF DESCRIPTION OF DRAWING

The single FIGURE of the drawing is a schematic illustration of an embodiment in accordance with the present invention.

BEST MODE FOR CARRYING OUT THE INVENTION

Adverting to tne drawing, there is illustrated therein a system 10 for supplying fluid flow to a hydraulic circuit 12. The system 10 has a pressurized fluid source 14, in the particular embodiment illustrated a single variable displacement pump. Pressure deliverable by the pressurized fluid source 14 is conventionally limited by a pressure relief valve 15. Control means 16, in the embodiment illustrated a three position valve spool 18, serves for controlling delivery of fluid flow from the pressurized fluid source 14 to the hydraulic circuit 12. In particular, fluid flows from the fluid supply source 14 via a conduit 20 to flow metering means 22, which comprises a metering spool 24 having passages **25*a* and 25*b* therethrough. The flow is then metered from the conduit 20 through the flow metering means 22 and into a conduit 26. Fluid flow goes from the conduit 26, past a check valve 28, to the valve spool 18 of the control means 16. Dependent upon the positioning of the valve spool 18, fluid will flow into or out of a head end 30 and out of or into a rod end 32 of a conventional hydraulic motor 34. Such flow occurs via conduits 36 and 38**.

If the valve spool 18 is in the position illustrated in the drawing, it is clear that flow does not proceed therepast. Instead, pressure is built up in a signal line 40 sufficiently to motivate the spool 24 of the flow metering means 22 downwardly, whereby the fluid in the conduit 20 is shunted into a bypass conduit 42, from which it passes into a sequentially connected hydraulic circuit 44, and from thence to a sump 46. It is noted that the circuit 44 may be omitted, in which case the flow introduced into the conduit 42 will be delivered directly to the sump 46.

If the valve spool 18 is shifted downwardly, flow from the conduit 26 goes past the check valve 28, through a variable flow metering orifice 48, and then through the conduit 38 to the rod end 32 of the hydraulic motor 34. Meanwhile, flow goes out of the head end 30 of the hydraulic motor 34 via the conduit 36 and then passes through the valve spool 18, and from thence via a conduit 50 to the sump 46.

When the valve spool 18 is shifted upwardly, flow proceeds from the conduit 26, past the check valve 28 and through a variable orifice 52, then to the conduit 36 and into the head end 30 of the hydraulic motor 34. Meanwhile, flow proceeds outwardly from the rod end 32 of the hydraulic motor 34, via the conduit 38 and the valve spool 18, and from thence to the aforementioned conduit 50 and the sump 46.

It should be noted that the flow metering means 22 is schematically represented, so as to indicate a proportioning of fluid between these two conduits, 26 and 42, and that in most modes of operation, particularly when the motor 34 is being moved in one direction or another, the entire flow passing through the flow metering means 22 will normally not pass into only one of the conduits 26 and 42.

The particular embodiment illustrated in the drawing is of the pilot controlled nature. That is, a pilot control valve 54 serves for controlling the position of the valve spool 18. Such pilot control valves 54 are conventional in nature. For example, British Pat. No. 1,494,400, published Dec. 7, 1977 and issued to Nordhydraulic AB discloses a valve usable, perhaps with slight modification, as an embodiment of the pilot control valve 54 discussed herein. It will be noted that pilot conduits 56 and 58 each connect with opposite ends of the valve spool 18 and that the valve spool 18 is normally biased by springs 60 and 62 to the central position illustrated in the drawing. In response to the operator shifting control lever 64 of pilot valve 54, the operator can select to pressurize either pilot conduit 56 or pilot conduit 58. If pilot conduit 56 is pressurized and pilot conduit 58 is not pressurized, the valve spool 18 is moved downwardly thereby accomplishing the connections formerly mentioned for that position thereof. If the pilot valve control lever 64 is operated by the operator to pressurize the pilot conduit 58 and depressurize the pilot conduit 56, then the valve spool 18 shifts upwardly with appropriate connections being made thereby. The pilot control valve 54, as illustrated, may operate off of an independent source of pressurized fluid 66 having its own relief valve 68. Alternatively, pressure from the pressurized fluid source 14 may be supplied to the pilot valve 54.

Referring particularly to the flow metering means 22, one will note most clearly the improvement of the present invention. In particular, it will be noted that the spool 24 of the flow metering means 22 is biased by a spring 70 acting against a first end 72 thereof, upwardly in the drawing. Meanwhile pressure from the line 40 is applied to a second end 74 of the metering spool 24 in opposition to the force of the spring 70. Thus, it is clear that the flow metering means 22 is normally biased into the open position shown in the drawing whereby substantially all of the flow therefrom proceeds via the conduit 26. However, as flow proceeds into the conduit 26, the pressure thereat builds up, and a pressure signal is delivered via the line 40 to the second end 74 of the metering spool 24. This provides a force in opposition to that of the spring 70. Accordingly, the metering spool 24 tends to shift downwardly, whereby only a portion of the flow from the conduit 20 passes toward the control means 18, while the rest is shunted off via the conduit 42. Further, pressure is detected at a line 76, corresponding to the pressure of the load being acted upon by the hydraulic motor 34. The line 76 delivers this pressure to the first end 72 of the metering spool 24 additively to the force of the spring 70. If a heavy load is being lifted, for example, it is clear that there will be a greater tendency for the metering spool 24 to be in the position illustrated in the drawing, whereby a higher flow is delivered from the conduit 20 to the conduit 26.

For a given orifice size of the variable orifice 48 or 52, a pressure drop is generated proportional to the flow passing through the orifice 48 or 52. The pressure upstream of the orifice 48 or 52 acts on the second end 74 of spool 24 and downstream, or load, pressure acts on first end 72 of spool 24, and for a given spring 70, a constant flow is maintained. With a very small pressure drop across orifice 48 or 52 (i.e., wide open), the pressure on both ends 72 and 74 of spool 24 are nearly equal and the spring 70 keeps the spool 24 shifted to direct full pump flow to the work circuit (motor 34). As the orifice 48 or 52 closes (becomes more restrictive), the pressure differential acting on the spool 24 is greater, and the spool 24 is shifted against spring 70, thus diverting more pump flow directly to sump 46 or to downstream hydraulic circuit 44.

As the main control valve spool 18 is shifted, the variable orifice 48 or 52 changes size relative to spool 18 displacement, thereby varying controlled flow through the flow control valve 22 to the main control valve 16 proportional to main spool 18 displacement.

In accordance with the present invention, a signal line 78 delivers a signal directly determined by operator positioning of the pilot valve control lever 64. The aforementioned valve of British Pat. No. 1,494,400 can be modified to add an output to signal line 78 responsive to movement of control lever 64. The signal is delivered to a chamber 80 on a side of a piston 82, which reciprocally fits within said chamber 80. This motivates the piston 82 towards the first end 72 of the flow metering spool 24. The pressure in the chamber 80 thus forces the piston 82 upwardly in the drawing and provides a force upwardly upon the flow metering spool 24 (acting via a spring 84) to force it toward the open position illustrated in the drawing. The spring 84 allows shifting of the metering spool 24 without movement of the piston 82. The line 78, chamber 80, piston 82 and spring 84, along with the pilot valve 54 and the pilot valve control lever 64, thus serve as means 86 for selectively controlling the magnitude of the portion of fluid flow metered by flow metering means 22 to the hydraulic circuit 12. On selective positioning by the operator of the pilot valve control lever 64, one can ensure that a greater portion of the flow from the conduit 20 passes to the conduit 26 via the flow metering means 22. This is useful, for example, if one desires to have a very fast lifting or lowering of a load by the hydraulic motor 34. Whether lifting or lowering is carried out depends upon the positioning of the valve spool 18 of the control means 16, which is also controlled by the pilot valve control lever 64, of pilot control valve 54.

Spring 70 may be eliminated provided needed spring rate can be acquired for spring 84 to give needed low and high range flow rates. The advantage of using two springs as shown in drawing is to overcome the problem of needing one spring with a given spring rate to establish the two flows (high and low) required for a given application.

Industrial Applicability

The present invention is particularly adapted for providing operator selectable flow rates for different functions of an apparatus such as a track type tractor. For example, different flow rates can be provided for raising and lowering the blade of such a tractor. Also, different flow rates can be delivered for a single function, such as raising the blade, so as to provide flexibility of operator control and operation. An operator simply adjusts the control lever 64 of the pilot control valve 54, or alternatively simply manually adjusts the position of valve spool 18, so as to choose, (1) the direction of motion of hydraulic motor 34, and (2) the flow rate thereto. The flow rate is controlled via a signal which may or may not be delivered, depending, for example, selectively upon the positioning of the pilot control lever 64, to the chamber 80, which signal acts upon the piston 82 to selectively provide an upward force upon the flow metering spool 24 of the flow metering means 22.

If, for example, the pressurized fluid source 14 is delivering an 80 gallon per minute flow to the conduit 20, in the absence of a signal in the line 78, the flow metering means 22 may deliver a 60 gallon per minute flow to the conduit 26 and a 20 gallon per minute flow to the conduit 42. The control means 16 may be connected to deliver flow via the conduit 36 and 38 to cause the hydraulic motor 34 to extend. On selective positioning of the pilot control lever 64 by the operator, pressure is supplied via the line 78 to the chamber 80 to act against the piston 82 which in turn acts against the first end 72 of the flow metering spool 24. This biases the flow metering spool 24 further upwardly in the drawing. As a result, the entire 80 gallon per minute flow in the conduit 20, or at least more than 60 gallons per minute flow (of the 80 gallons per minute flow in the conduit 20) is delivered to the conduit 26. In this manner, a higher flow rate is obtained within the hydraulic circuit 12. And, all of this is obtained with only a single fluid source 14.

Other aspects, objects and advantages of this invention can be obtained from a study of the drawings, disclosure and the appended claims.

We claim:

1. In a system (10) for supplying fluid flow to a hydraulic work circuit (12), the system (10) having a single pressurized fluid source (14) for supplying pressurized fluid thereto, control valve means (16) for controlling delivery of fluid flow from said source (14) to selectively drive the circuit (12) and flow control means (22) for metering a portion of the fluid flow to the hydraulic circuit (12), the improvement comprising:

means (86) for controlling the magnitude of said portion in response to application thereto of a signal;

operator controlled input means (78) for operator selectively applying said signal to said means (86) for operator selectively directly controlling the magnitude of said portion in direct response to a controlling action inititated by an operator;

and wherein said flow control means (22) includes:

a valve element (24) positionable in a first position and in a second position;

means (70) for biasing said element (24) towards said first position thereof;

means (25*a*, 25*b*) for allowing fluid flow to pass through said flow metering means (22) to said control valve means (16) in response to said element (24) being in said first position and for preventing said fluid flow in response to said element (24) being in said second position;

means (40) for opposing said biasing means (70) with a force determined by a pressure of said portion intermediate said flow control means (22) and said control valve means (16); and means (76) for adding a force representative of the load to that of said biasing means (70) in response to a load experienced by said circuit (12);

and wherein said signal applying means (78) adds a force to that of said biasing means (70), the added force being in response to selective operator input.

2. The improvement as in claim 1, including:

pilot operated control valve means (54) for selecting the signal applied by said signal applying means (78).

3. The improvement as in claim 1, wherein said control valve means (16) includes a main control valve spool 18.

4. The improvement as in claim 1, wherein said valve element (24) is a spool (24), said spool (24) having a first end (72) and being reciprocally mounted, wherein said biasing means (70) acts against said first end (72) of the spool (24), wherein said means (86) for selectively directly controlling the magnitude of said portion includes a chamber (80) and a piston (82) in said chamber (80), said piston (82) communicating with said spool first end (72), and wherein said signal applying means (78) applies pressure to said chamber (80) on a side of said piston (82) removed from the spool (24).

5. The improvement as in claim 4, including:

pilot operated control valve means (54); and means (64) for operator adjustment of said pilot operated control valve means (54) for selecting the signal applied by said signal applying means (78).

6. The improvement as in claim 1, including at least one additional hydraulic circuit (44) and wherein said control means (22) meters the remainder of said fluid flow to said additional circuit (44).

* * * * *